US009383129B2

(12) United States Patent
Lim et al.

(10) Patent No.: US 9,383,129 B2
(45) Date of Patent: Jul. 5, 2016

(54) REFRIGERATOR AND ICE STORAGE CONTAINER THEREFOR

(75) Inventors: Seung Tae Lim, Gwangju (KR); Dong Hwa Kim, Gwangju (KR); Dong In Shin, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 751 days.

(21) Appl. No.: 12/588,011

(22) Filed: Sep. 30, 2009

(65) Prior Publication Data

US 2010/0077789 A1 Apr. 1, 2010

(30) Foreign Application Priority Data

Oct. 1, 2008 (KR) ..... 10-2008-96500

(51) Int. Cl.
*F25C 5/18* (2006.01)
*F25C 5/00* (2006.01)
(Continued)

(52) U.S. Cl.
CPC ..... *F25C 5/005* (2013.01); *F25C 5/182* (2013.01); *F25C 5/18* (2013.01); *F25C 2400/10* (2013.01); *F25D 11/02* (2013.01); *F25D 13/00* (2013.01); *F25D 23/04* (2013.01); *F25D 2317/061* (2013.01); *F25D 2317/062* (2013.01);
(Continued)

(58) Field of Classification Search
CPC ..... F25C 5/18; F25C 5/182; F25C 2400/10; F25D 13/00; F25D 11/02; F25D 23/04; F25D 2317/062; F25D 2317/0665; F25D 2317/0666; F25D 2317/067
USPC ..... 62/344, 377, 420, 425; 292/56, 108, 292/109, 219, 226, 228, 202, 203, 210, 304
See application file for complete search history.

(56) References Cited

U.S. PATENT DOCUMENTS 3,520,568 A * 7/1970 White et al. ..... 292/255
3,709,538 A * 1/1973 Seitz et al. ..... 292/128
(Continued)

FOREIGN PATENT DOCUMENTS

EP 1 788 329 5/2007
JP 2005-291682 10/2005
(Continued)

OTHER PUBLICATIONS

Korean Office Action issued Sep. 29, 2014 in corresponding Korean Application No. 10-2008-0096500.
(Continued)

*Primary Examiner* — Frantz Jules
*Assistant Examiner* — Webeshet Mengesha
(74) *Attorney, Agent, or Firm* — Staas & Halsey LLP

(57) ABSTRACT

A refrigerator includes an ice storage container coupled to a mounting space of an inner wall of a freezing chamber door, and the ice storage container is attachable to and detachable from the mounting space by elastic lever units to maintain and release locking of the ice storage container with the mounting space, and elastic coupling units to maintain coupling of the ice storage container to the mounting space by elastic deformation and restrict movement of the ice storage container in the horizontal direction of the mounting space when the ice storage container is mounted on the mounting space, thereby preventing abrasion and breakdown of components due to user's ease in the assembly of the ice storage container and increase in the fixing force of the ice storage container.

9 Claims, 6 Drawing Sheets

(51) Int. Cl.
*F25D 13/00* (2006.01)
*F25D 11/02* (2006.01)
*F25D 23/04* (2006.01)

(52) U.S. Cl.
CPC ... *F25D2317/067* (2013.01); *F25D 2317/0665* (2013.01); *F25D 2317/0666* (2013.01)

(56) References Cited

U.S. PATENT DOCUMENTS

| | | | | |
|---|---|---|---|---|
| 4,186,978 | A * | 2/1980 | Thomson | 312/321.5 |
| 5,535,437 | A * | 7/1996 | Karl et al. | 455/575.1 |
| 5,577,779 | A * | 11/1996 | Dangel | 292/80 |
| 5,762,224 | A * | 6/1998 | Benn et al. | 220/4.02 |
| 6,050,013 | A * | 4/2000 | Heaton et al. | 40/570 |
| D439,822 | S * | 4/2001 | Webber et al. | D8/331 |
| 6,378,918 | B1 * | 4/2002 | Mita et al. | 292/103 |
| 7,036,895 | B2 * | 5/2006 | Han | 312/404 |
| 7,437,886 | B2 * | 10/2008 | Kuehl et al. | 62/344 |
| 7,797,961 | B2 * | 9/2010 | An et al. | 62/353 |
| 7,832,227 | B2 * | 11/2010 | Wu et al. | 62/344 |
| 7,963,120 | B2 * | 6/2011 | An et al. | 62/344 |
| 8,015,837 | B2 * | 9/2011 | Kim | 62/344 |
| 8,033,133 | B2 * | 10/2011 | Flores et al. | 62/344 |
| 8,667,809 | B2 * | 3/2014 | Kim et al. | 62/344 |
| 2005/0073227 | A1 * | 4/2005 | Shin | 312/404 |
| 2006/0086130 | A1 * | 4/2006 | Anselmino et al. | 62/344 |
| 2006/0097610 | A1 * | 5/2006 | Lee et al. | 312/401 |
| 2007/0113578 | A1 * | 5/2007 | Wu et al. | 62/344 |
| 2008/0115521 | A1 * | 5/2008 | Anderson | 62/344 |
| 2008/0134709 | A1 * | 6/2008 | Fischer et al. | 62/344 |
| 2008/0134710 | A1 * | 6/2008 | An et al. | 62/344 |
| 2009/0064704 | A1 * | 3/2009 | Wu et al. | 62/344 |
| 2009/0173098 | A1 * | 7/2009 | Kim et al. | 62/344 |
| 2009/0211292 | A1 * | 8/2009 | Smith et al. | 62/344 |
| 2009/0229284 | A1 * | 9/2009 | Fulton | 62/137 |
| 2010/0287970 | A1 * | 11/2010 | Choi | 62/344 |

FOREIGN PATENT DOCUMENTS

| | | |
|---|---|---|
| KR | 10-0717434 | 5/2007 |
| KR | 10-2007-0096376 | 10/2007 |
| KR | 10-2008-0016026 | 2/2008 |
| WO | WO 2008/032986 | 3/2008 |

OTHER PUBLICATIONS

European Search Report issued Nov. 22, 2013 in corresponding European Application No. 09171457.6.

* cited by examiner

REFRIGERATOR AND ICE STORAGE CONTAINER THEREFOR

CROSS-REFERENCE TO RELATED APPLICATIONS

This application claims the benefit of Korean Patent Application No. 2008-0096500, filed on Oct. 1, 2008 in the Korean Intellectual Property Office, the disclosure of which is incorporated herein by reference.

BACKGROUND

1. Field

Embodiments of the present invention relate to a mounting structure of an ice storage container, which stores ice cubes made by an ice maker of a refrigerator.

2. Description of the Related Art

In general, a refrigerator is an apparatus that supplies cool air of a low temperature to storage chambers to store foods within the storage chambers at a low temperature in a fresh state. The refrigerator includes a freezing chamber maintaining a temperature not exceeding the freezing point, and a refrigerating chamber maintaining a temperature slightly above the freezing point.

Recently, in order to make life more convenient, there is provided a refrigerator, in which an ice maker to make ice cubes is installed in a freezing chamber and an ice storage container to store the ice cubes made by the ice maker is provided.

Such an ice maker is generally installed within the freezing chamber of the refrigerator, but a refrigerator, in which an ice maker is mounted on the inner wall of a door of a freezing chamber to utilize a storage space in the freezing chamber, has been developed.

That is, the ice maker is attached to the inner wall of the freezing chamber door and makes ice cubes by cool air supplied to the freezing chamber, and the ice storage container is attachably and detachably installed on the inner wall of the door below the ice maker.

However, if the ice storage container installed on the inner wall of the freezing chamber door is not stably coupled to the inner wall of the door, the ice storage container moves, thereby causing abrasion and breakdown of components.

SUMMARY

Therefore, it is one aspect of the present invention to provide a mounting structure of an ice storage container, which minimizes movement and is easily attached to and detached from a door of a refrigerator.

Additional aspects of the invention will be set forth in part in the description which follows and, in part, will be apparent from the description, or may be learned by practice of the invention.

In accordance with one aspect, a refrigerator includes an ice storage container coupled to a mounting space of an inner wall of a freezing chamber door, wherein the ice storage container is attachable to and detachable from the mounting space by elastic lever units to maintain and release locking of the ice storage container with the mounting space, and elastic coupling units to maintain coupling of the ice storage container to the mounting space by elastic deformation and restrict movement of the ice storage container in the horizontal direction of the mounting space when the ice storage container is mounted on the mounting space.

Lock recesses to restrict movement of the upper portion of the ice storage container in the forward direction of the mounting space when the ice storage container is mounted on the mounting space may be provided on the upper portion of the mounting space.

Each of the elastic lever units may include an elastic lever including a rotary shaft rotatably connected to the ice storage container, a push part supported by elastic members, and a hook part to maintain the locking, and a lever coupling part provided on the mounting space and including a lock part, with which the hook part is locked.

Each of the elastic coupling units may include an elastic coupling groove including a support part provided on the ice storage container and an elastic part bent from one end of the support part to have elastic force, and a coupling protrusion provided on the mounting space and inserted into the elastic coupling groove.

A guide rib may be provided on the ice storage container, and a guide groove to guide an approach direction of the guide rib when the ice storage container is coupled to the mounting space may be provided on a mounting bottom of the lower portion of the mounting space.

In accordance with another aspect, a refrigerator includes an ice storage container coupled to a mounting space of an inner wall of a freezing chamber door, wherein the ice storage container is attachable to and detachable from the mounting space by elastic lever units to maintain and release locking of the ice storage container with the mounting space, and lock recesses provided on the upper portion of the mounting space to restrict movement of the upper portion of the ice storage container in the forward direction of the mounting space when the ice storage container is mounted on the mounting space.

Each of the elastic lever units may include an elastic lever including a rotary shaft rotatably connected to the ice storage container, a push part supported by elastic members, and a hook part to maintain the locking, and a lever coupling part provided on the mounting space and including a lock part, with which the hook part is locked.

The ice storage container may be rotated on the lock recesses when the ice storage container is attached to and detached from the mounting space.

A guide rib may be provided on the ice storage container, and a guide groove to guide an approach direction of the guide rib when the ice storage container is coupled to the mounting space may be provided on a mounting bottom of the lower portion of the mounting space.

Elastic coupling units to restrict movement of the ice storage container in the horizontal direction of the mounting space may be further provided on the ice storage container or the inner wall of the freezing chamber door.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF EMBODIMENTS

Figure 1:
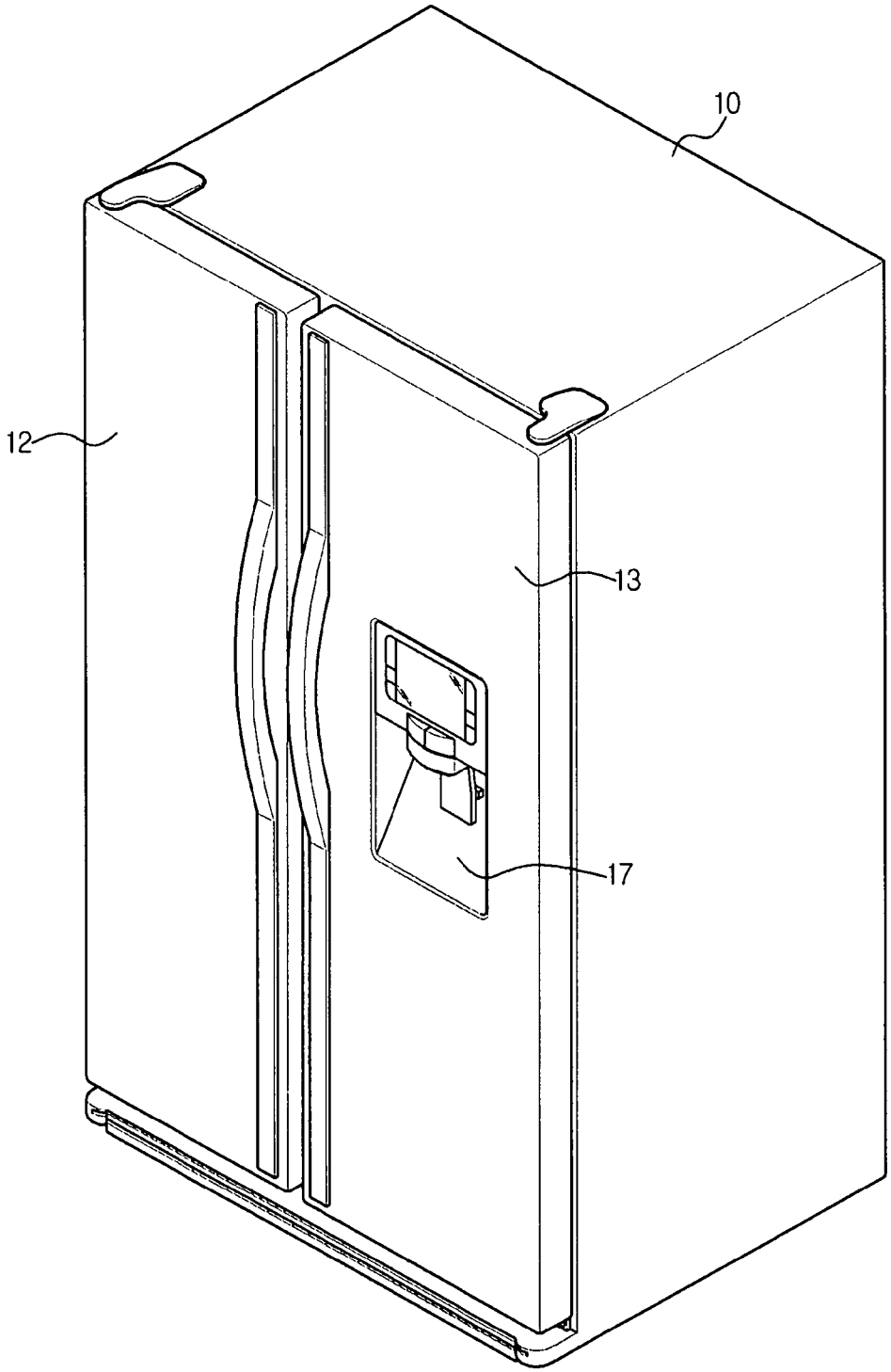
FIG. 1 is a perspective view of a refrigerator in accordance with one embodiment.

Reference will now be made in detail to the embodiments of the present invention, examples of which are illustrated in the accompanying drawings, wherein like reference numerals refer to like elements throughout.

Figure 2:
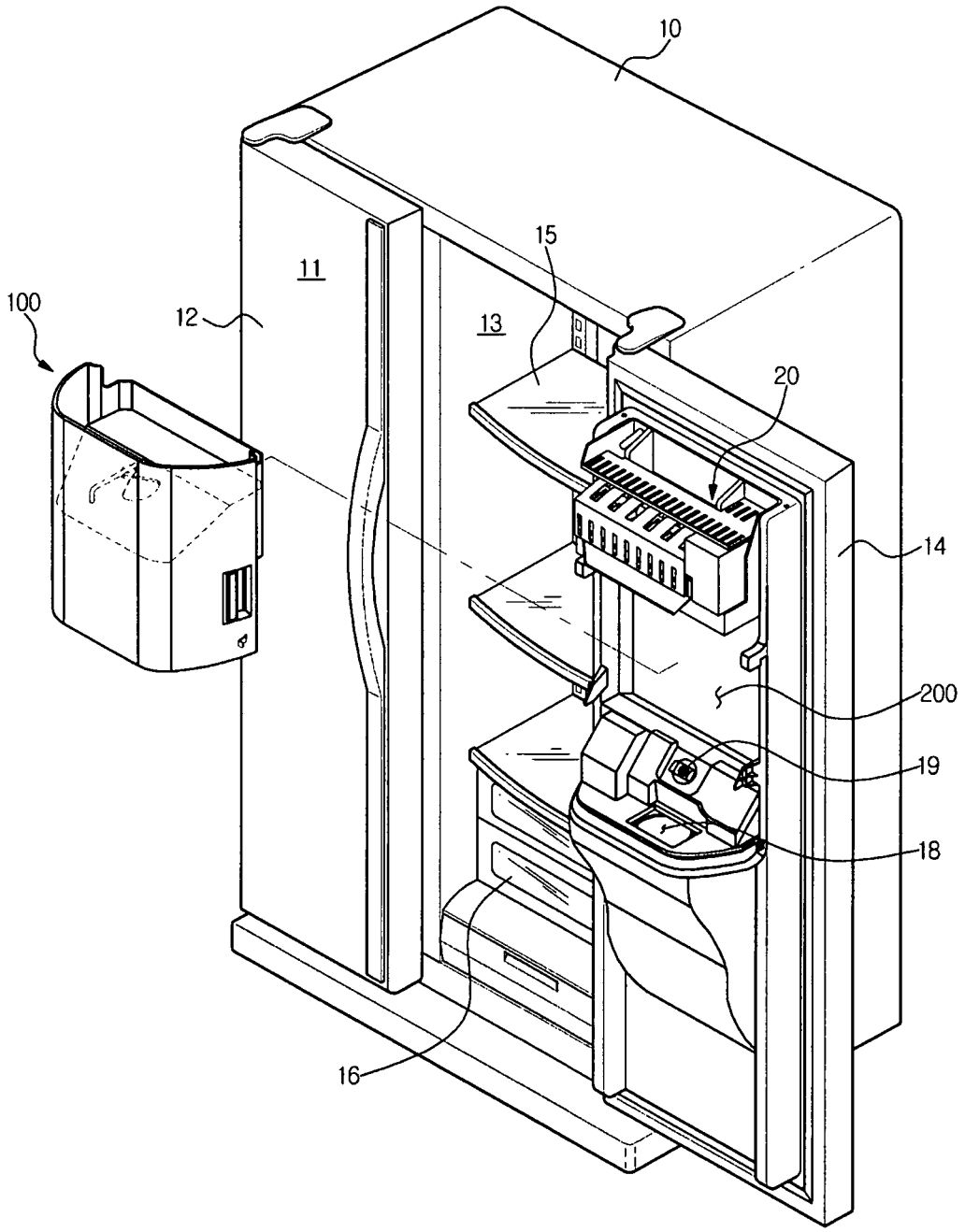
FIG. 2 is a perspective view illustrating the internal structure of the refrigerator in accordance with the embodiment.

FIG. 1 is a perspective view of a refrigerator in accordance with one embodiment, and FIG. 2 is a perspective view illustrating the internal structure of the refrigerator in accordance with the embodiment.

With reference to FIGS. 1 and 2, the refrigerator in accordance with the embodiment includes a main body 10, the inside of which is divided into a freezing chamber 13 on the right side and a refrigerating chamber 11 on the left side, and a freezing chamber door 14 and a refrigerating chamber door 12 respectively at both sides of a front surface part of the main body 10 to open and close the freezing chamber 13 and the refrigerating chamber 11.

Although this embodiment illustrates the freezing chamber 13 provided on the right side, a freezing chamber may be provided on the left side, or two freezing chambers may be respectively provided on both sides.

A cooling apparatus (not shown) to cool the freezing chamber 13 and the refrigerating chamber 11 is provided in the main body 10, and includes a compressor, a condenser, an evaporator, and a decompression device.

At least one rack 15, upon which food is placed, is installed in the freezing chamber 13, and drawer-type storage containers 16 are provided in the lower portion of the freezing chamber 13.

An ice maker 20 to make ice cubes is installed at the upper portion of the inner wall of the freezing chamber door 14, and an ice storage container 100 to store the ice cubes made by the ice maker 20 is installed below the ice maker 20. The ice cubes made by the ice maker 20 are dropped into the ice storage container 100, and the ice cubes in the ice storage container 100 are transferred to a dispenser unit 17 provided below the ice storage container 100.

The dispenser unit 17 is formed to a designated depth as an indentation in the front surface of the freezing chamber door 14, and an ice discharge path 18 connecting the dispenser unit 17 and the freezing chamber 13 is provided in the freezing chamber door 14. The ice discharge path 18 guides the ice cubes discharged from the ice storage container 100 to the dispenser unit 17.

Figure 3:
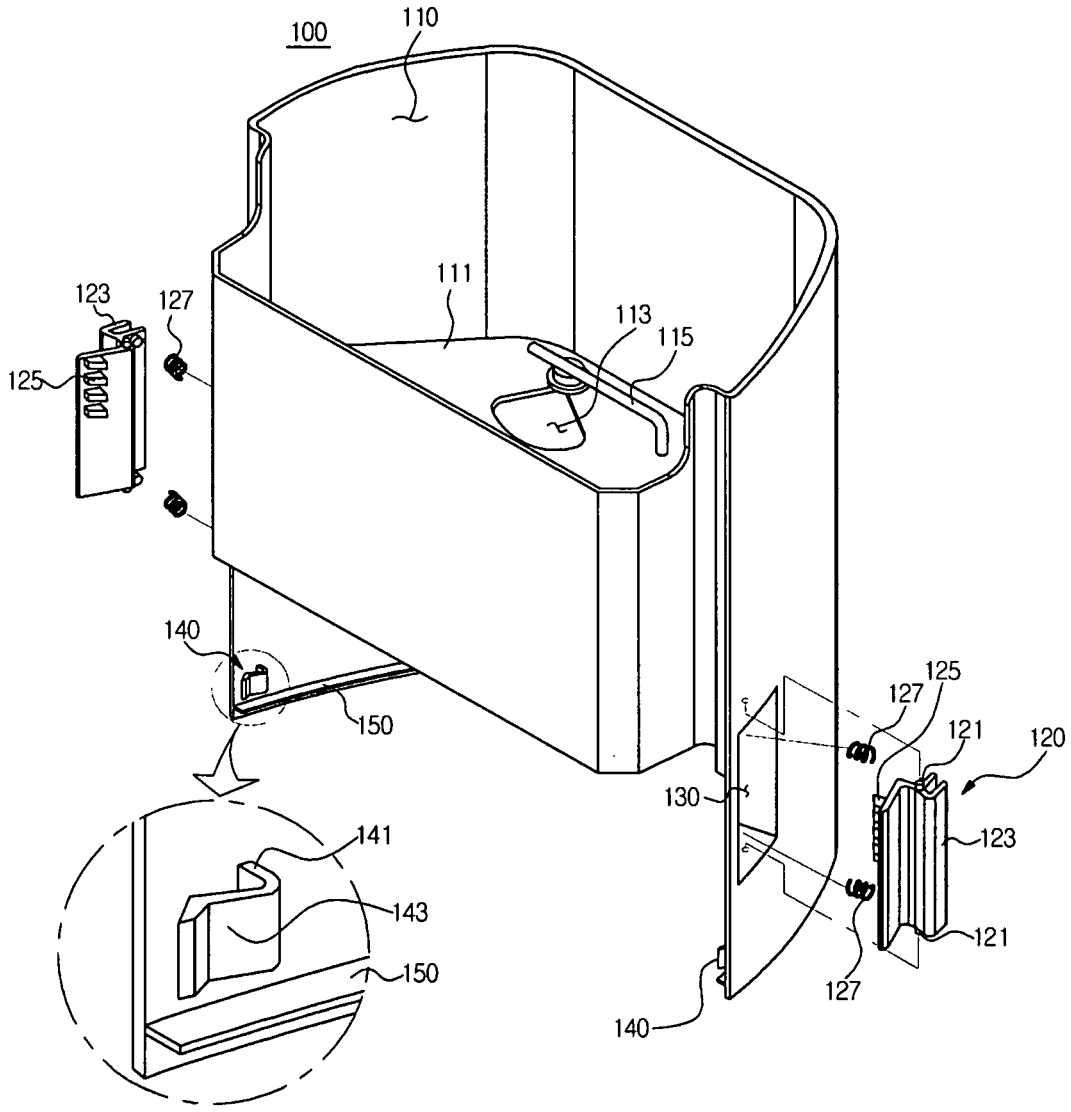
FIG. 3 is an exploded perspective view illustrating an ice storage container of the refrigerator in accordance with the embodiment.

The ice storage container 100, as shown in FIG. 3, is provided with a reception space 110 to receive ice cubes, and the upper surface of the reception space 110 is opened.

A slope 111 inclined to easily discharge the received ice cubes is provided in the reception space 110, and a discharge port 113 to discharge the ice cubes stored in the reception space 110 is formed through the slope 111.

An auger 115 to guide the ice cubes to the discharge port 113 is provided on the slope 111. The auger 115 is coupled with a rotating member 19, which is provided on the lower portion of a mounting space 200 of the freezing chamber 14 to be rotated by a driving device, and is rotated.

A hook-type elastic lever 120 to easily attach and detach the ice storage container 100 to and from the mounting space 200 of the freezing chamber door 14 is rotatably connected to an elastic lever reception part 130 provided on each of both side surfaces of the ice storage container 100.

Each of the elastic levers 120 includes a push part 123 for a pushing operation provided at one side of a rotary shaft 121 hinged to the elastic lever reception part 130, and a hook part 125 provided at the other side of the rotary shaft 121.

Further, elastic members 127 are provided to press the push part 123 to the outside of the elastic lever reception part 130 when the elastic lever 120 is rotatably connected to the elastic lever reception part 130.

Thereby, under the condition that a user does not apply pressure to the push part 123, the elastic members 127 press the push part 123 to the outside of the elastic lever reception part 130, and thus the hook part 125 is turned toward the inside of the elastic lever reception part 130 centering on the rotary shaft 121.

An elastic coupling groove 140 to prevent the ice storage container 100 from moving in the horizontal direction when the ice storage container 100 is coupled to the mounting space 200 of the freezing chamber door 14 is provided on the lower end of each of both sides of the ice storage container 100.

Each of the elastic coupling grooves 140 includes a support part 141 extended inwardly from the inner surface of one side of the ice storage container 100, and an elastic part 143 bent from one end of the support part 141 to have elastic force.

Figure 4:
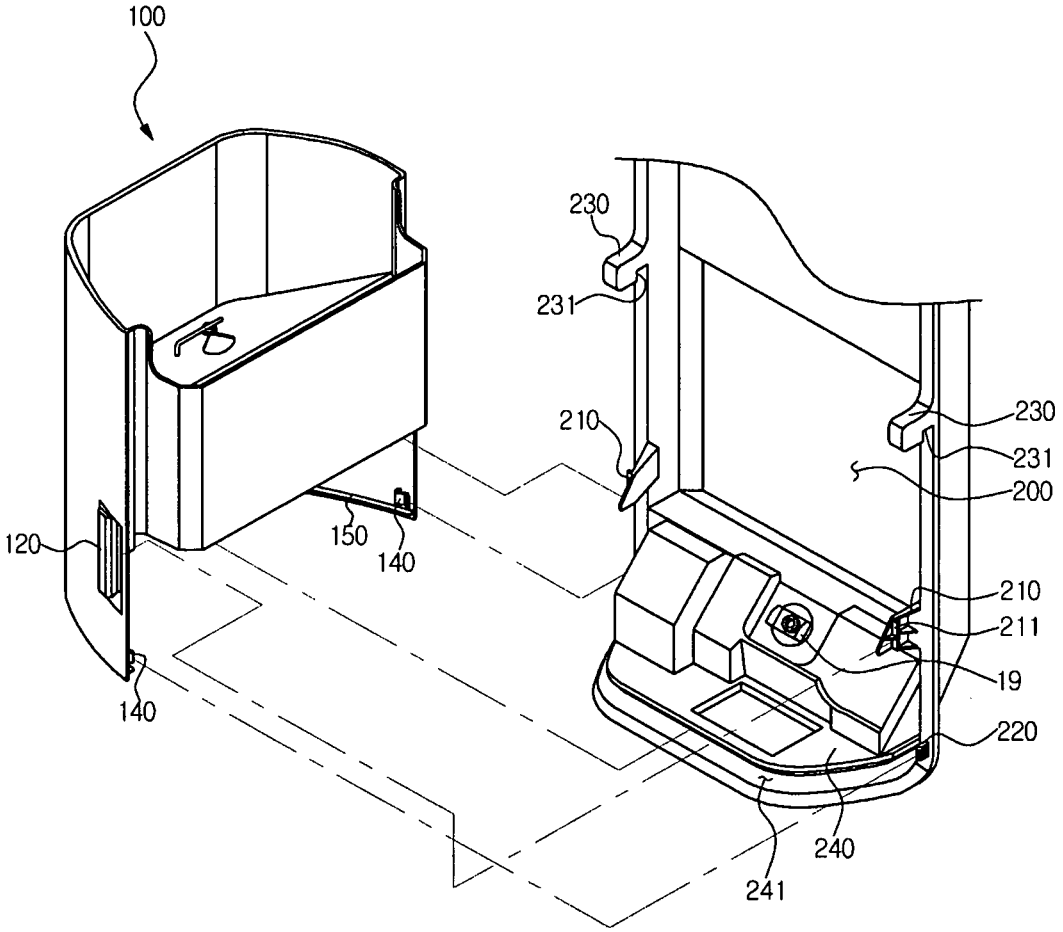
FIG. 4 is a partial perspective view of the refrigerator in accordance with the embodiment.

Further, as shown in FIG. 4, lever coupling parts 210 are provided at positions of the mounting space 200 of the freezing chamber door 14 corresponding to the elastic levers 120 when the ice storage container 100 is coupled to the mounting space 200.

Each of the lever coupling parts 210 includes a lock part 211 protruded to the outside of the mounting space 200 such that the hook part 125 of the elastic lever 120 is locked with the lock part 211.

That is, in an elastic lever unit including the elastic lever 120 and the lever coupling part 210, the elastic lever 120 and the lever coupling part 210 are hooked to each other to maintain or release the locking between the ice storage container 100 and the mounting space 200 when the ice storage container 100 is installed on the mounting space 200.

A coupling protrusion 220, which is inserted into each of the elastic coupling grooves 140 of the ice storage container 100 when the ice storage container 100 is coupled to the mounting space 200, is provided on the lower portion of each of both sides of the mounting space 200.

That is, through the configuration of an elastic coupling unit including the coupling protrusion 220 and the elastic coupling groove 140, when the coupling protrusion 220 is inserted into the elastic coupling groove 140, the elastic part 143 of the elastic coupling groove 140 is elastically deformed outwardly and is interconnected with the coupling protrusion 220, and thus the movement of the ice storage container 100 in the horizontal direction of the mounting space 200 is restricted.

Although the embodiment describes that the elastic coupling grooves 140 are provided on the ice storage container 100 and the coupling protrusions 220 are provided on the mounting space 200, the elastic coupling grooves 140 may be provided on the mounting space 200 and the coupling protrusions 220 may be provided on the ice storage container 100.

Further, a lock rib 230 to prevent the upper portion of the ice storage container 100 from moving in the forward and backward direction of the mounting space 200 when the ice storage container 100 is coupled to the mounting space 200 of the freezing chamber door 14 is provided on the upper portion of each of both side surfaces of the mounting space 200.

The lock ribs 230 are protruded to the outside of the mounting space 200, and each of the lock ribs 230 includes a lock recess 231 to receive and support each of corners of the upper end of the ice storage container 100.

Through the above configuration, when the ice storage container 100 is coupled to the mounting space 200 of the freezing chamber door 14, the corners of the upper end of the ice storage container 100 are inserted into the lock recesses 231, thereby preventing the movement of the ice storage container 100 in the forward and backward direction of the mounting space 200.

Further, a guide rib 150 is provided on the lower part of the ice storage container 100, and a guide groove 241 to guide an approach direction of the guide rib 150 of the ice storage container 100, when the ice storage container 100 is coupled to the mounting space 200, is provided on a mounting bottom 240 of the mounting space 200, which supports a bottom of the ice storage container 100.

Figure 5:
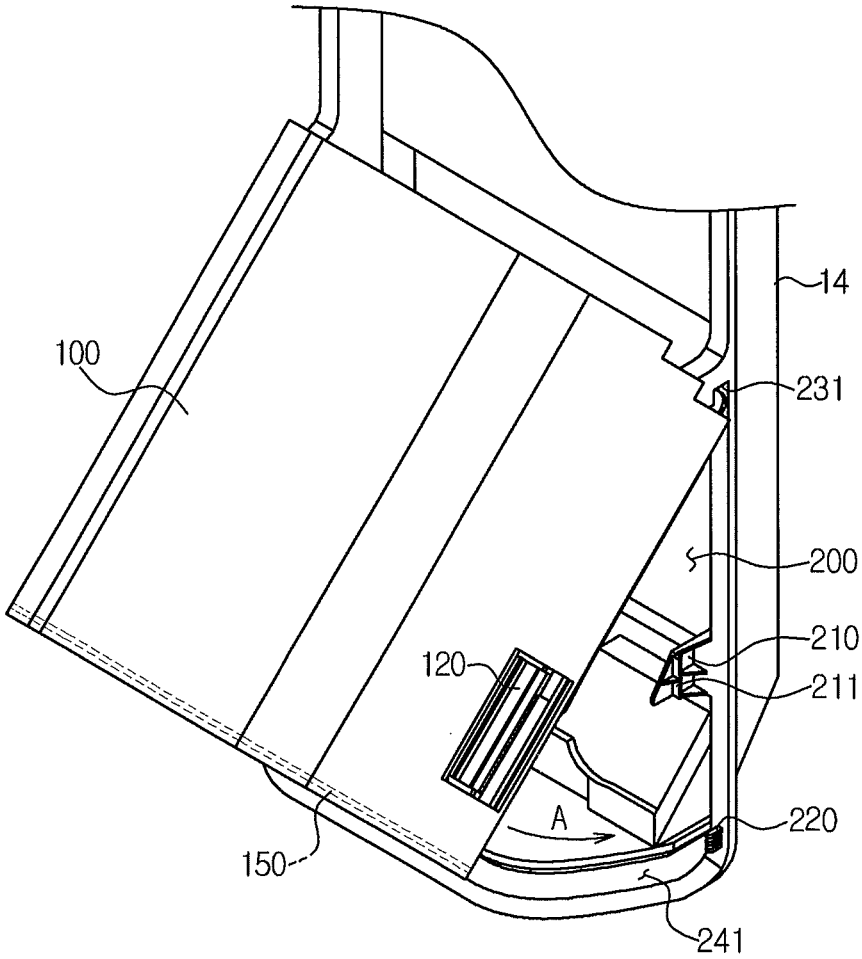
FIGS. 5 and 6 are views illustrating an attaching/detaching process of the ice storage container in accordance with the embodiment.
Figure 6:
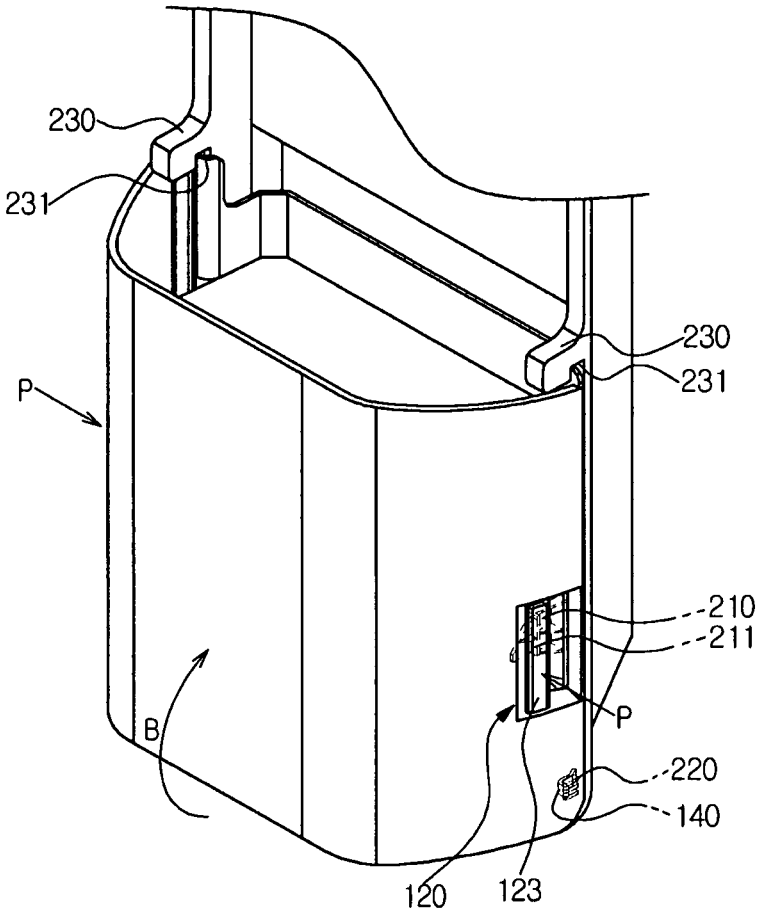

Hereinafter, a coupling structure and effects of the ice storage container of the refrigerator in accordance with the embodiment of the present invention will be described. FIGS. 5 and 6 are views illustrating an attaching/detaching operation of the ice storage container of the refrigerator in accordance with the embodiment of the present invention.

With reference to FIGS. 3 and 5, in order to mount the ice storage container 100 on the mounting space 200 provided on the inner wall of the freezing chamber door 14, firstly a user inserts the corners of the upper end of the ice storage container 100 into the lock recesses 231 provided on the upper portion of the mounting space 200.

The ice storage container 100 inserted into the lock recesses 231 is rotatable on the lock recesses 231. When the user rotates the ice storage container 100 in the direction A, the guide rib 150 of the ice storage container 100 is inserted into the guide groove 241 provided on the mounting bottom 240 of the mounting space 200, and thus the guide groove 241 guides an assembly position of the storage container 100.

When the user continuously rotates the ice storage container 100 in the direction A, the coupling protrusions 220 elastically deform the elastic parts 143 of the elastic coupling grooves 140 and thus enter the elastic coupling grooves 140, and when the user rotates the ice storage container 100 until the coupling protrusions 220 contact the support parts 141 of the elastic coupling grooves 140, the hook parts 125 of the elastic levers 120 are connected to the lock parts 211 of the lever coupling parts 210, as shown in FIG. 6.

In this case, the movement of the ice storage container 100, mounted on the mounting space 200 of the inner wall of the freezing chamber door 14, in the horizontal direction is restricted by the elastic coupling units, each of which includes the coupling protrusion 220 and the elastic coupling groove 140, and after the coupling between the coupling protrusions 220 and the elastic coupling grooves 140 has been completed, fixing force is improved by the elastic parts 143 of the elastic coupling grooves 140.

Since the rotation of the upper portion of the storage container 100 in the forward direction of the mounting space 200 is restricted by the lock recesses 231, the movement of the ice storage container 100 on the mounting space 200 is further minimized.

In order to separate the ice storage container 100 from the mounting space 200, when a user applies pressure to the push parts 123 of the elastic levers 120 provided at both side surfaces of the ice storage container 100 in the direction P using both hands, the locking of the hook parts 125 of the elastic levers 120 with the lock parts 211 of the lever coupling parts 210 is released.

Thereafter, when the user rotates the ice storage container 100 in the direction B, the ice storage container 100 is rotated on the lock recesses 231 and the coupling protrusions 220 are separated from the elastic coupling grooves 140, simultaneously, and thereby the ice storage container 100 is easily separated from the mounting space 200.

In this way, the mounting and separation of the ice storage container 100 on and from the mounting space 200 is achieved by a simple operation. Therefore, a user may easily attach and detach the ice storage container 100 to and from the mounting space 200, and thus ease in the assembly of the ice storage container 100 is improved.

As is apparent from the above description, in a refrigerator in accordance with one embodiment, an ice storage container is easily attached to and detached from a mounting space, and the movement of the ice storage container due to external impact is minimized by increase in fixing force and thus abrasion and breakdown of components are prevented.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

an ice storage container coupled to a mounting space of an inner wall of a freezing chamber door, the ice storage container being attachable to and detachable from the mounting space;

elastic lever units to maintain and release locking of the ice storage container to the mounting space;

lock ribs each having a lock recess, the lock ribs and each lock recess being provided on the freezing chamber door to restrict movement of the ice storage container in a dismounting direction of the mounting space of the freezing chamber door when the ice storage container is mounted on the mounting space;

elastic coupling units formed on a body of the ice storage container, the elastic coupling units including an elastic coupling groove including a support part provided on the ice storage container and an elastic part bent from one end of the support part to have elastic force; and a coupling protrusion provided on the mounting space and inserted into the elastic coupling groove, such that the coupling protrusion is gripped between the elastic part and the body of the ice storage container, wherein an end of the ice storage container pivotally turns on the lock recesses of the lock ribs while coupled to the lock recesses such that another end of the ice storage container moves in the dismounting direction of the mounting space, whereby the ice storage container is configured to be gripped by a user and installed by the elastic lever units provided at both sides of the ice storage container, wherein the lock recesses of the lock ribs are indentations which are included on a bottom portion of each of the lock ribs and the ice storage container pivotally turns on each of the lock recesses of the lock ribs, and wherein the lock ribs extend horizontally from the inner wall of the freezing chamber door.

2. The refrigerator according to claim 1, wherein each of the elastic lever units includes an elastic lever including a rotary shaft rotatably connected to the ice storage container, a push part supported by elastic members, and a hook part to maintain the locking, and a lever coupling part provided on the mounting space and including a lock part, with which the hook part is locked.

3. A refrigerator comprising:

an ice storage container coupled to a mounting space of an inner wall of a freezing chamber door, the ice storage container being attachable to and detachable from the mounting space;

elastic lever units to maintain and release locking of the ice storage container to the mounting space;

a plurality of lock ribs each including a lock recess, the lock ribs and each lock recess being provided on the freezing chamber door to restrict movement of the ice storage container in a dismounting direction of the mounting space when the ice storage container is mounted on the mounting space;

elastic coupling units formed on a body of the ice storage container, the elastic coupling units including an elastic coupling groove including a support part provided on the ice storage container and an elastic part bent from one end of the support part to have elastic force; and a coupling protrusion provided on the mounting space and inserted into the elastic coupling groove, such that the coupling protrusion is gripped between the elastic part and the body of the ice storage container, wherein an end of the ice storage container pivotally turns on the lock recesses of the plurality of lock ribs while coupled to each lock recess such that another end of the ice storage container moves in the dismounting direction of the mounting space, whereby the ice storage container is configured to be gripped by a user and installed by the elastic lever units provided at both sides of the ice storage container, wherein the lock recesses of the plurality of lock ribs are indentations which are included on a bottom portion each of the plurality of lock ribs and the ice storage container pivotally turns on each of the lock recesses of the plurality of lock ribs, and wherein the plurality of lock ribs extend horizontally from the inner wall of the freezing chamber door.

4. The refrigerator according to claim 3, wherein each of the elastic lever units includes an elastic lever including a rotary shaft rotatably connected to the ice storage container, a push part supported by elastic members, and a hook part to maintain the locking, and a lever coupling part provided on the mounting space and including a lock part, with which the hook part is locked.

5. The refrigerator according to claim 1, further comprising a guide rib provided on the ice storage container, the guide rib extending along the entire inner circumference of a lower part of the ice storage container.

6. The refrigerator according to claim 5, further comprising a guide groove corresponding to the guide rib to guide an approach direction of the guide rib when the ice storage container is coupled to the mounting space provided on a mounting bottom of a lower portion of the mounting space.

7. The refrigerator according to claim 3, further comprising a guide rib provided on the ice storage container, the guide rib extending along the entire inner circumference of a lower part of the ice storage container.

8. The refrigerator according to claim 7, further comprising a guide groove corresponding to the guide rib to guide an approach direction of the guide rib when the ice storage container is coupled to the mounting space provided on a mounting bottom of a lower portion of the mounting space.

9. The refrigerator according to claim 1, wherein the elastic coupling units maintain coupling of the ice storage container to the mounting space by elastic deformation and restrict movement of the ice storage container in a horizontal plane of the mounting space when the ice storage container is mounted on the mounting space.

* * * * *